United States Patent [19]

Shirasugi

[11] Patent Number: 4,996,564

[45] Date of Patent: Feb. 26, 1991

[54] CONTROLLABLE DRIVE OF OPTICS OF A COPIER

[75] Inventor: Kouji Shirasugi, Yokohama, Japan

[73] Assignee: Ricoh Company, Ltd., Tokyo, Japan

[21] Appl. No.: 370,870

[22] Filed: Jun. 23, 1989

[30] Foreign Application Priority Data

Jun. 24, 1988 [JP] Japan ..... 63-156326

[51] Int. Cl.[5] ..... G03G 15/28

[52] U.S. Cl. ..... 355/235; 355/233

[58] Field of Search ..... 355/233, 234, 235, 236, 355/204

[56] References Cited

U.S. PATENT DOCUMENTS 4,332,460 6/1982 Costanza ..... 355/236

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

A method of controllably driving optics of a copier in the form of a scanner which is movable relative to an original document being laid on a glass platen. The optics is usually returned in a high-speed return mode after imagewise exposure so as to enhance rapid copying. In a two-sided or a composite copy mode in which a paper sheet is driven into an image forming station of the copier before the optics reaches a timing for starting forming an image, the high speed return mode for controlling the optics is switched over to a low-speed return mode.

6 Claims, 6 Drawing Sheets

38
48
M
E
VMM
Tr1
Tr2
Tr3
Tr4
60
62
64
OSC
OUT
OUT1
OUT0
GATE1
GATE0
CLK1
CLK0
D0
D1
D2
D3
D4
D5
D6
D7
A0
A1
CS
WR
RD
54
AD0
AD1
AD2
AD3
AD4
AD5
AD6
AD7
A8
A9
A10
CW
CCW
PF6
PF7
PD0
PF0
MICROCOMPUTER
CI
PC7
X1
X2
PC6
46
CLR
PR
Q
CLK
D
58
52
50
56
Vcc
ENCA
ENCB
44
HP
SENSOR

| Fig. 6A | Fig. 6B |
|---|---|

CONTROLLABLE DRIVE OF OPTICS OF A COPIER

BACKGROUND OF THE INVENTION

The present invention relates to a method of controllably driving optics of a copier in the form of a scanner which is movable relative to an original document being laid on a glass platen.

In a copier of the type described, a scanner is driven at a predetermined speed during a scanning movement and at a higher speed during a returning movement. Especially, with a modern high-speed copier, high CPM (Count Per Minute) operations have to be implemented by reducing the period of time necessary for the return of the scanner which does not contribute to image forming at all. More specifically, while the rate of a scanning movement of the scanner is severely restricted for copying process reasons, the rate of a returning movement is free from this kind of restriction and, therefore, allows the returning time to be reduced for high CPM operations. It is a common practice to effect such returning movements at a high speed with no regard to the copy mode. As regards the high-speed returning movements, the position where the scanner should be brought to a stop in the vicinity of a home position thereof often fluctuates due to the fluctuation in the inertia and other factors of the optics and other similar loads. This does not matter at all during an ordinary copy mode operation, because the timing for feeding a paper sheet from a paper cassette can be controlled.

However, assume a two-sided copy mode or a composite copy mode in which two one-sided documents of format A4 which are fed sideways, for example, are transported and illuminated one after the other to reproduce them side by side on a paper sheet of format A3 which is fed lengthwise. Then, image transfer is executed with each of the leading and trailing halves of the same paper sheet and, as regards the second image transfer (second page), the paper sheet is driven into the image forming station before the scanner starts forming an image. More specifically, when the scanner starts forming an image, the paper sheet carrying an image on the leading half thereof has already moved away from a paper register station to make contact with a photoconductive element. In this kind of copy mode, should the stop position of the scanner fluctuate due to the high-speed return, the position for starting driving the scanner would also fluctuate resulting in the leading edge of an image fluctuating on the paper sheet.

SUMMARY OF THE INVENTION

It is therefore an object of the present invention to provide a method of controllably driving optics of a copier which allows an image to be transferred to a paper sheet with the leading edge thereof accurately assuming a predetermined position in any of various kinds of copy modes.

It is another object of the present invention to provide a method of controllably driving optics of a copier which stops the optics at a predetermined position accurately and stably.

It is another object of the present invention to provide a generally improved method of controllably driving optics of a copier.

In accordance with the present invention, in a method of controllably driving optics of a copier in the form of a scanner, which is movable relative to a stationary glass platen, which controls the optics in a high-speed return mode after imagewise exposure, in a particular mode which drives a paper sheet into an image forming station of the copier before the optics reaches a timing for starting forming an image, the high speed return mode for controlling the optics is switched over to a low-speed return mode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

A preferred embodiment of the present invention will be described with reference to the accompanying drawings.

Figure 1:
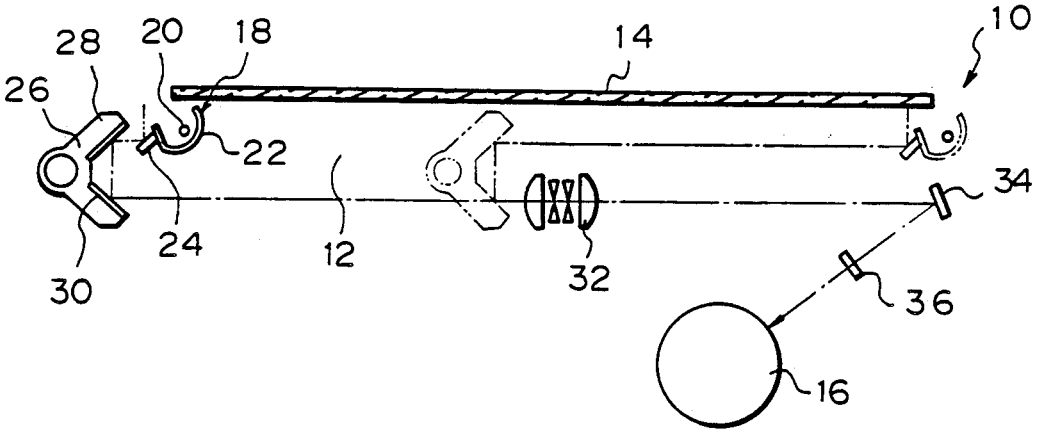
FIG. 1 is a schematic side elevation of optics of a copier to which the present invention is applied.
Figure 2:
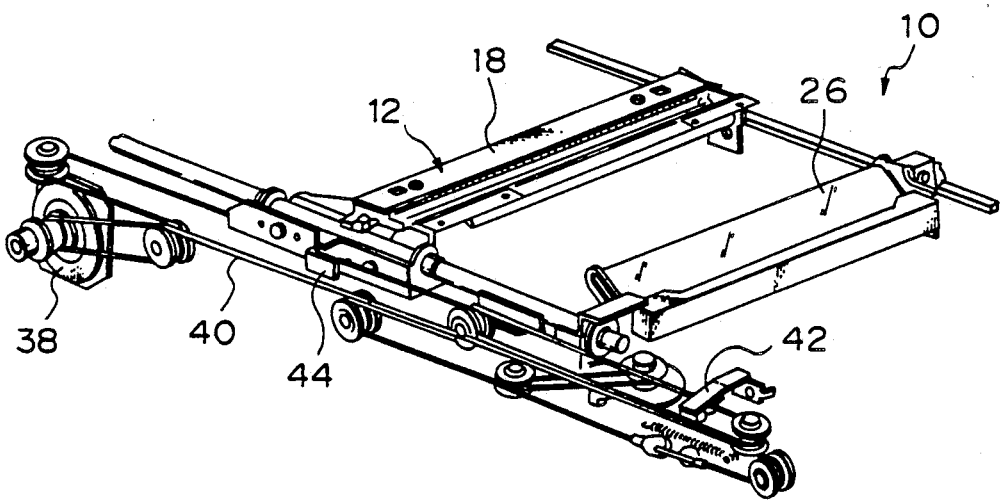
FIG. 2 is a perspective view of an arrangement for driving the optics shown in FIG. 1.

FIG. 1 scehmatically indicates the optical arrangement a copier of the type to which the present invention pertains. The optical arrangement, generally 10, has scanning optics 12 which is disposed below a glass platen 14 that is to be loaded with an original document (not shown). A reflection from an original document is focused by the optics 12 onto a photoconductive drum 16 in the form of a drum. The optics 12 has a first scanner 18, a second scanner 26, a lens 32, a mirror 34, etc. The first scanner 18 is loaded with a light source 20, a reflector 22 and a mirror 24, while the second scanner 26 is loaded with mirrors 28 and 30. The reference numeral 36 designates a dust glass. As shown in FIG. 2, a DC motor 38 and a scanner wire 40 drive the first and second scanners 18 and 26 back and forth at a speed ratio of 2:1, so that the length of the optical path as measured from the document may not change during the course of scanning. The driving system shown in FIG. 2 per se is well known in the art and will not be described in detail herein. A home position (HP) sensor 42 is located in a predetermined position of the driving system which corresponds to a reference position of the optics 12. In the illustrative embodiment, the HP sensor 42 is implemented as a photointerrupter. The first scanner 18 carries therewith an intercepting plate 44 which blocks the optical path of the HP sensor 42 when the scanner 18 reaches the home position.

As the optics 12 is driven to the right as viewed in FIG. 1 away from the home position which is indicated by a solid line in FIG. 1, it sequentially scans an original document being laid on the glass platen 14. The positions of the scanners 18 and 26 indicated by phantom lines in FIG. 1 are associated with the maximum scanning stroke available with the copier. After a scanning movement, the optics 12 is returned toward the home position. Generally, during the return, the optics 12 is driven at a higher speed than during the scanning movement and, as it approaches the home position, sequentially decelerated. As soon as the intercepting plate 44 traverses the optical path of the HP sensor 42, the rotating direction of the DC motor 38 is switched from reverse (scanner returning direction) to forward (scanner scanning direction) to thereby shift the optics 12 from an overrun position to the home position. In this construction, the optics 12 made up of the first and second scanners 18 and 26 and the scanner wire 40 are the loads which are driven by the DC motor 38.

Figure 3:
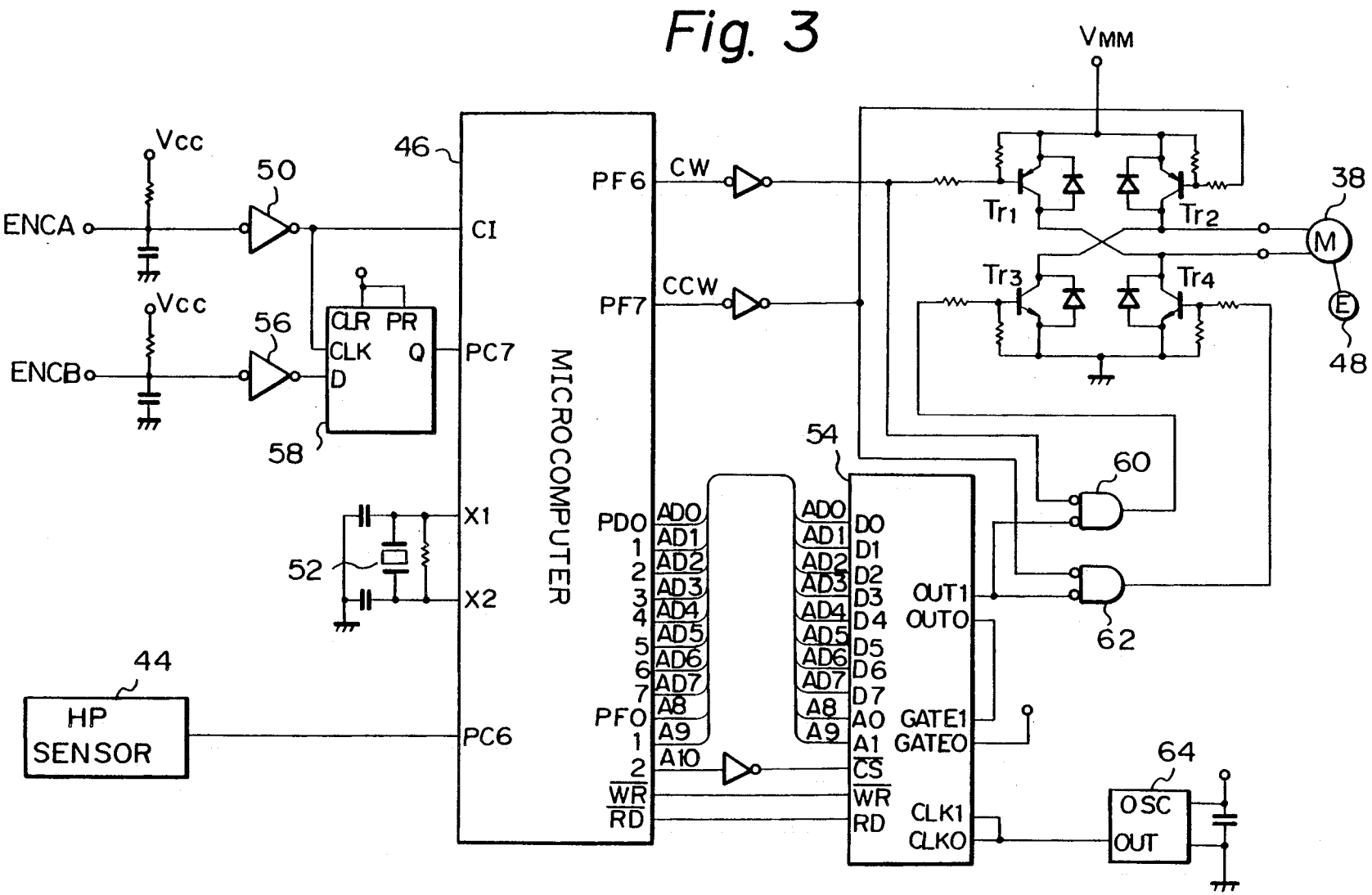
FIG. 3 is a schematic block diagram showing a control system for driving the optics and representative of a preferred embodiment of the present invention.

Referring to FIG. 3, a control system for controlling the movements of the optics 12 is shown. The control system has a microcomputer 46 which includes a CPU (Central Processing Unit), ROM (Read Only Memory), I/O (Input/Output) ports, etc. Implemented by μPD7811G, for example, the microcomputer 46 has a transmit and a receive interface for communicating with a controller which governs the entire copier. Encoder pulses ENCA associated with the rotation speed of the DC motor 38 are applied to an interrupt terminal, or counter input terminal, CI of the microcomputer 46. The encoder pulses ENCA are generated by an encoder 48 which is directly connected to the DC motor 38. Specifically, the encoder 48 generates two pulse signals of different phases which are associated with the amount of rotation of the motor 38 and the direction of rotation of the same, respectively. One of the two pulse signals is the A phase encoder pulses ENCA, and the other is B phase encoder pulses ENCB. The A phase encoder pulses ENCA are fed to the counter input terminal CI of the microcomputer 46 via a buffer 50. By using a built-in counter, the microcomputer 46 measures the intervals between the consecutive A phase encoder pulses ENC. The built-in counter is operable at a frequency which is one-twelfth of the oscillation frequency of an oscillator 52 included in the microcomputer 46. In response to the input to the counter input terminal CI, the microcomputer 46 executes an interrupt program which will be described. Briefly, the interrupt program consists in reading data representative of an interval between consecutive encoder pulses ENCA (value of a timer/event counter capture register (ECNT)), determining the instantaneous rotation speed of the DC motor 38 (speed of the first scanner 18) based on the read data, producing a difference between the actual motor speed and a target motor speed, calculating an mount of motor control (ON time of PWM (Pulse Width Modulation) control) to be effected, and outputting the calculated amount (loading a programmable interval timer 54 which will be described with the data). The B phase encoder pulses ENCB are applied to a terminal PC7 of the microcomputer 46 via a buffer 56 and a flip-flop 58.

The programmable interval timer 54 mentioned above is connected to the microcomputer 46 and is implemented by a μP8253-2, for example. The DC motor 38 is connected to the microcomputer 46 via transistors $Tr_1$ to $Tr_4$ which serve as H type driver circuitry. Specifically, when output terminals P6 and PF7 of the microcomputer 47 has a (logical) high level or "H", the DC motor 38 is deenergized; when the terminals PF6 has a (logical) low level or "L" and the terminal PF7 has "H", the transistors $Tr_1$ and $Tr_3$ are turned on while the transistors $Tr_2$ and $Tr_4$ are turned off resulting in a current which rotates clockwise (CW) flowing through the motor 38; and when the terminal PF6 has "H" and the terminal PF7 has "L", the transistor $Tr_2$ and $Tr_4$ are turned on while the transistors $Tr_1$ and $Tr_3$ are turned off resulting in a current which rotates counterclockwise (CCW) flowing through the motor 38. The motor 38 drives the optics 12 into a scanning movement when rotated clockwise and drives it into a returning movement when rotated counterclockwise. The DC motor 38 is controlled on the basis of PWM control of the timer 54 and by on/off controlling the transistor $Tr_3$ or $Tr_4$ via gates 60 and 62 to which a one-shot output of the timer 54 is applied. Although not shown in the figure, a stepping motor is connected to the microcomputer 46 for moving the lens 32 and second scanner 26 to their particular positions associated with a desired magnification. The reference numeral 64 designates a pulse generator.

Figure 4A:
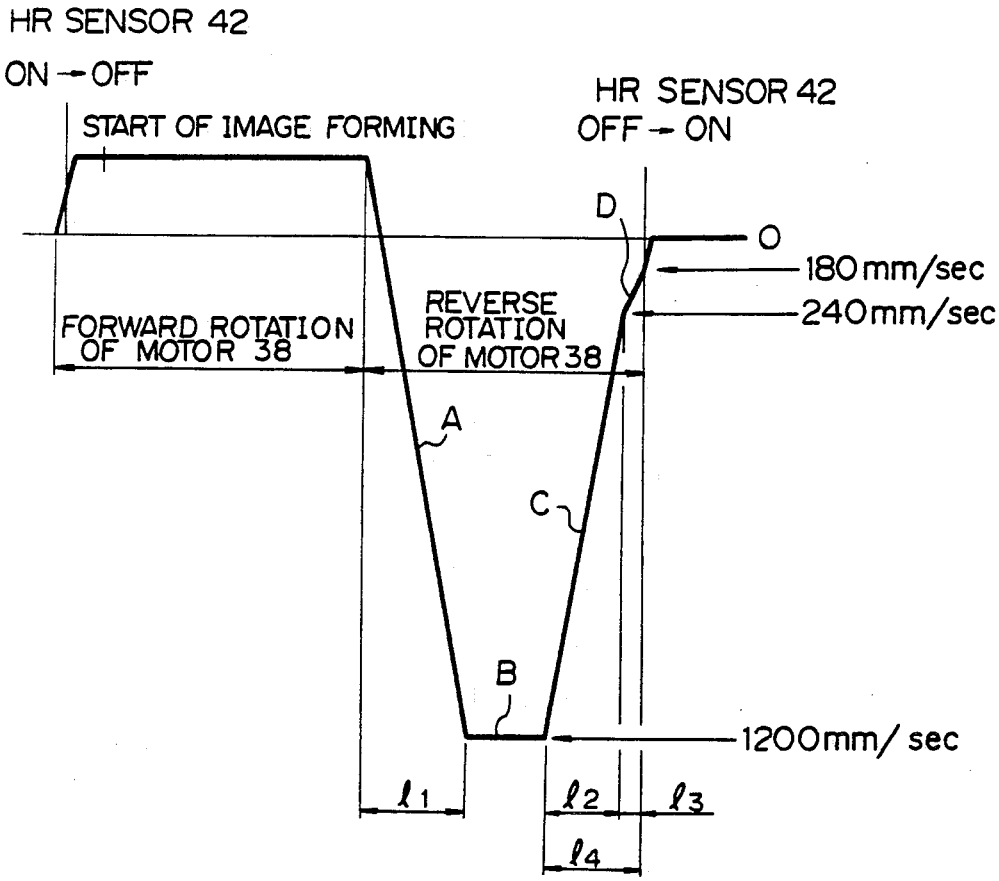
FIG. 4A plots motor speeds controlled in a high-speed return mode.

FIG. 4A plots the velocities of the DC motor 38 which are derived from the above-stated encoder control in an ordinary copy mode. In the figure, the forward rotation range of the motor 38 is associated with the forward or scanning movement of the first and second scanners 18 and 26, i.e., the image forming range, while the reverse rotation range is associated with the return movement of the scanners 18 and 26, i.e., the range outside of the image forming range. The high-speed return mode shown in FIG. 4A will be described in detail hereinafter.

In the initial portion of the reverse rotation range as represented by a segment A, the target return speed is set at 400 millimeters per second at first. The target return speed is incremented by 16 millimeters per second every time an encoder pulse interrupt occurs, and the target upper limit of 1200 millimeters pr second is set. In practice, the target upper limit of 1200 millimeters per second is reached in response to the fiftieth encoder pulse interrupt. After the motor 38 has been driven at the constant target speed of 1200 millimeters per second for a predetermined period of time as represented by a segment B, a transition to a deceleration control portion occurs as represented by a segment C, the target speed is sequentially decremented by 12 millimeters per second in response to every encoder pulse interrupt. This deceleration continues until eighty encoder pulses appear in total, as counted from the start of deceleration. The control portion C is followed by a control portion represented by a segment D. In this portion D, the speed of 240 millimeters per second is sequentially decremented by 4 millimeters per second every time an encoder pulse interrupt occurs; a speed of 180 millimeters per second is reached when the HP sensor 42 is brought to the intercepting plate 44. This corresponds to fifteen encoder pulse interrupts. Thereafter, the optics 12 is further decelerated, moved away from the home position, and stopped.

The high-speed return of the optics 12 described above realizes high CPM operations of the copier.

Figure 4B:
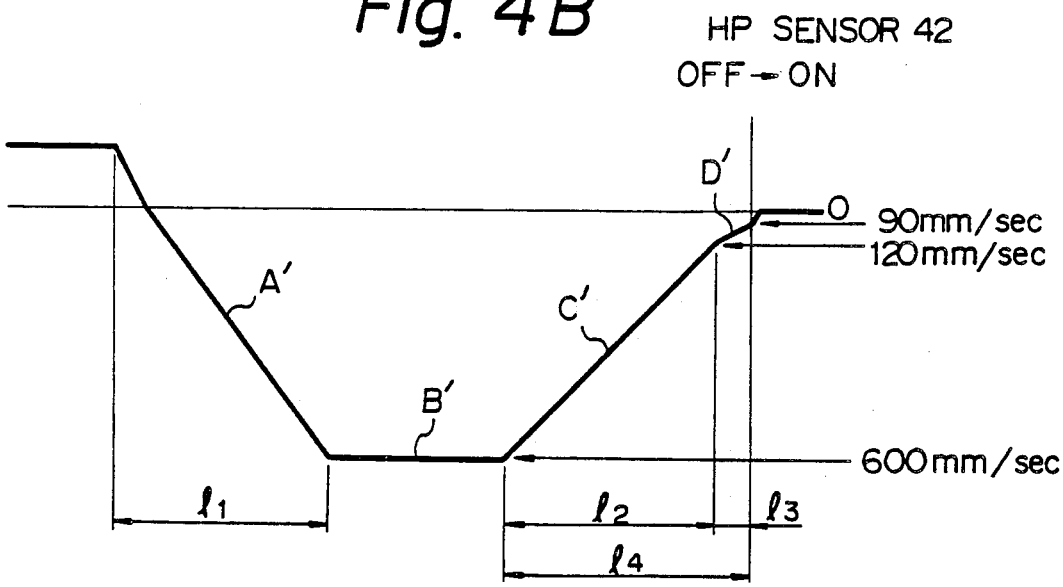
FIG. 4B plots motor speeds implemented by a low-speed return mode.

Nevertheless, even when the intercepting plate 44 interrupts the optical path of the HP sensor 42 (i.e. when the home position is reached), the motor 38 cannot reach a sufficiently low speed, as indicated by the segment D in FIG. 4A. This is apt to prevent the first and second scanners 18 and 26 from being brought to a stop at predetermined positions due to the fluctuation in the inertia of the optics 12 and other loads, as discussed earlier. Then, assuming a particular copy mode wherein a paper sheet is to be driven into the image forming station of the copier before the optics 12 reaches a timing for forming an image, the period of time which it takes the optics 12 to reach the image forming start position as counted from the start of drive is not constant and causes the image transfer position on a paper sheet to fluctuate. In the light of this, in the illustrative embodiment, a low-speed return mode shown in FIG. 4B is available in addition to the high-speed return mode of FIG. 4A. Specifically, in the above-mentioned particular mode wherein a paper sheet is to be driven into the image forming station before the optics 12 reaches the timing for starting forming an image, the optics 12 is returned at the low speed as shown in FIG. 14B.

In FIG. 4B, in an acceleration control portion represented by a segment A' which corresponds to the segment A of FIG. 4A, the target return speed is set at 200 millimeters per second at first. Then, the target speed is increased by 8 millimeters per second in response to every encoder pulse interrupt while the upper return limit is set at 600 millimeters per second. In the subsequent portion B' corresponding to the portion B, the optics 12 is driven constantly at the speed of 600 millimeters per second for a predetermined period of time. In the next portion C' which corresponds to the portion C, the upper return limit of 600 millimeters per second is decremented by 6 millimeters per second every time an encoder pulse interrupt occurs. Such a deceleration is repeated until the eightieth encoder pulse arrives as counted from the start of deceleration. The optics 12 reached the return speed of 120 millimeters per second by the above procedure is sequentially decelerated, as represented by a segment D' in FIG. 4B. In the portion D', the target speed is decremented by 2 millimeters per second in response to every encoder pulse interrupt. At the instant when the HP sensor 42 arrives at the intercepting plate 44, the optics 12 has been decelerated to a speed of 90 millimeters per second.

In FIGS. 4A and 4B, it is to be noted that the distances of the associated rising and falling portions A and A', C and C' and D and D' are the same as each other with no regard to the returning speed. For example, the distances $l_1$, $l_2$, $l_3$ and $l_4$ may be 39.3 millimeters, 62.9 millimeters, 8 millimeters and 74.7 millimeters, respectively. Consequently, in the low-speed return mode, not only the maximum return speed but also the acceleration and deceleration rates are one half of those of the high-speed return mode. Also, it takes the HP sensor 42 a longer period of time to reach the intercepting plate 44 in the low-speed return mode than in the high-speed return mode. In the low-speed return mode, therefore, the influence of the inertia and other factors of the optics and other similar loads are negligible, so that the first and second scanners 18 and 26 can be surely brought to a stop at their predetermined positions when the HP sensor 42 reaches the intercepting plate 44 even in the previously stated particular mode. Although the low-speed return mode will somewhat increase the copying time needed to complete a copying cycle, it will not be adopted except for a few rare copy modes and will not be critical.

In the illustrative embodiment, the high-speed return mode is set up in an ordinary copy mode as in the prior art, while the low-speed return mode is automatically set up when the operator selects some particular copy mode, i.e., it is not open to choice. Specifically, the low-speed return mode is exclusively assigned to the previously stated special copy mode such as a two-sided copy mode or a composite copy mode. That is, the low-speed return mode cannot be selected on the copier body alone and is not available with a copier of the type having no two-sided/composite copy unit mounted on its boy. The low-speed return mode, therefore, will be set up on condition that an exclusive table and a two-sided/composite copy unit are mounted on the copier body, that the operation board of the copier is replaced with an exclusive panel associated with the two-sided/-composite copy unit, and that a dip switch on a main controller is manipulated to a two-sided/composite copy unit mount mode. Once these conditions are satisfied, the operator may select a mode 4 of series copy (for reproducing two one-sided documents of format A4 which are fed sideways on one side of a single paper sheet of size A3 which is fed lengthwise) by manipulating a series copy mode key on the replaced panel. Since such a special copy mode is rarely used, the keys for entering series copy modes are concealed by a cover or the like in order to insure the manipulability of the copier. Further, even when this kind of special mode is selected, the copier will be unoperable unless paper sheets are set lengthwise. When a copying operation is started with the mode 4 of serial copy being selected, the optics 12 will be returned in the low-speed return mode as shown in FIG. 4B.

Figure 5:
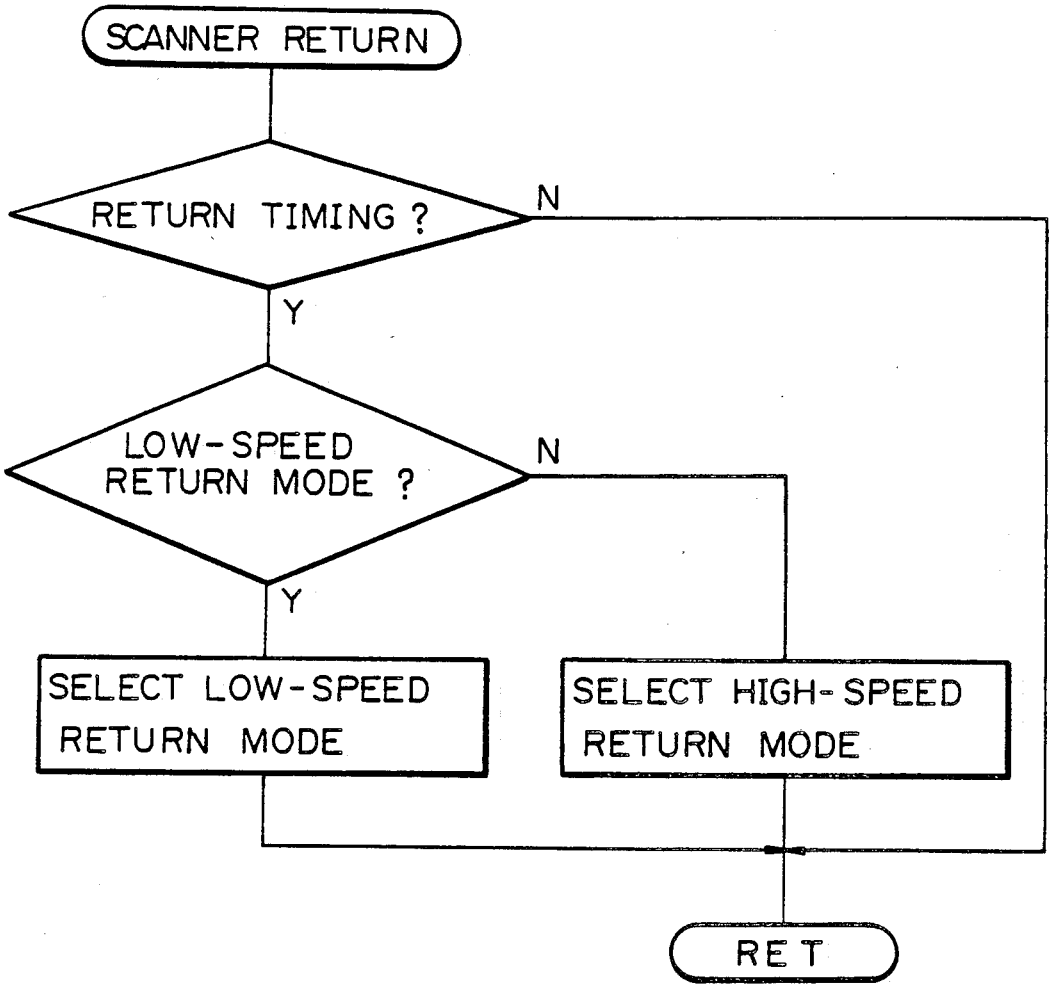
FIG. 5 is a flowchart demonstrating the switchover of the high-speed and low-speed return modes.
Figures 6, 6A:
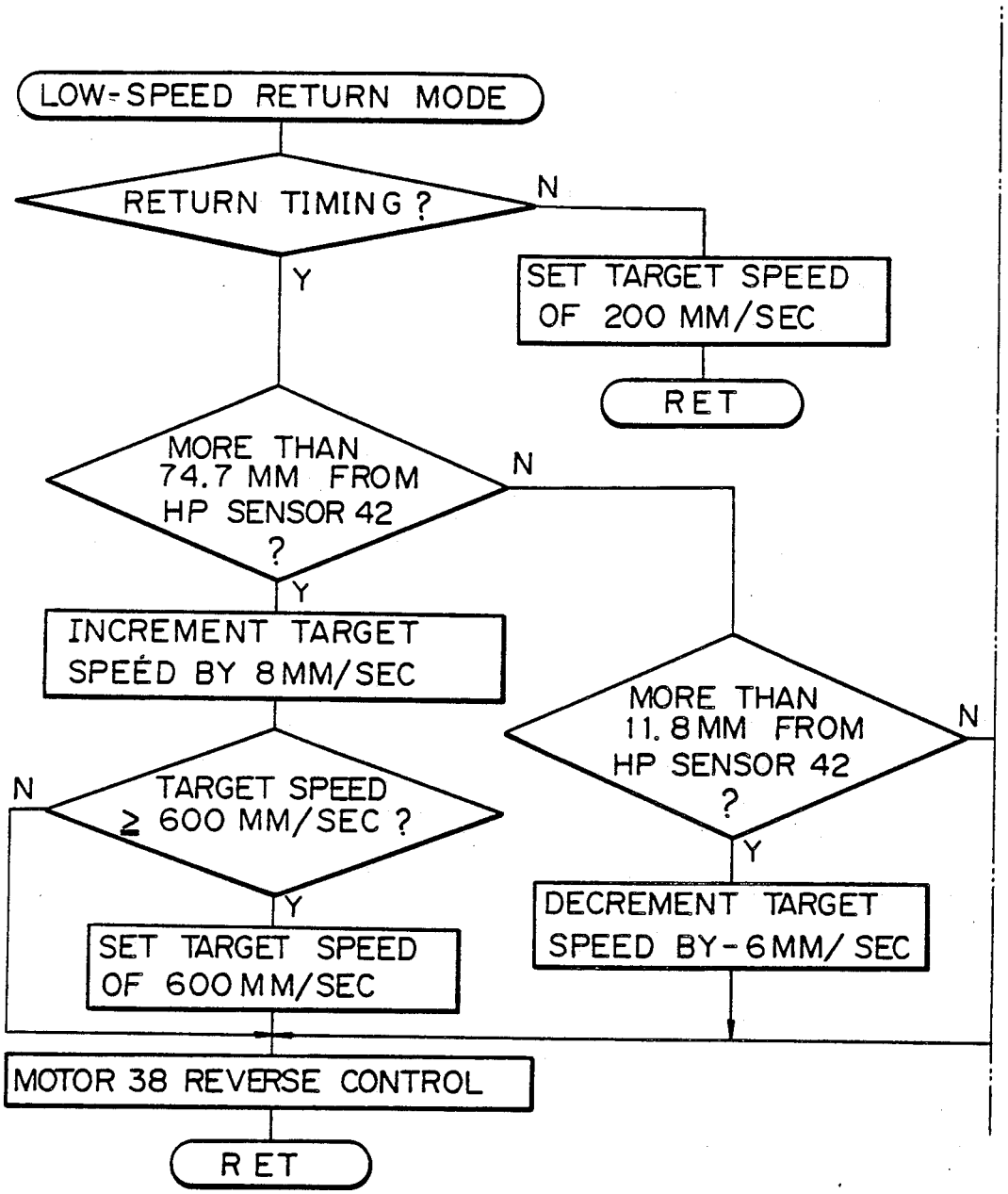
FIG. 6 is a flowchart representative of a specific control procedure which is executed in the low-speed return mode.
Figure 6B:
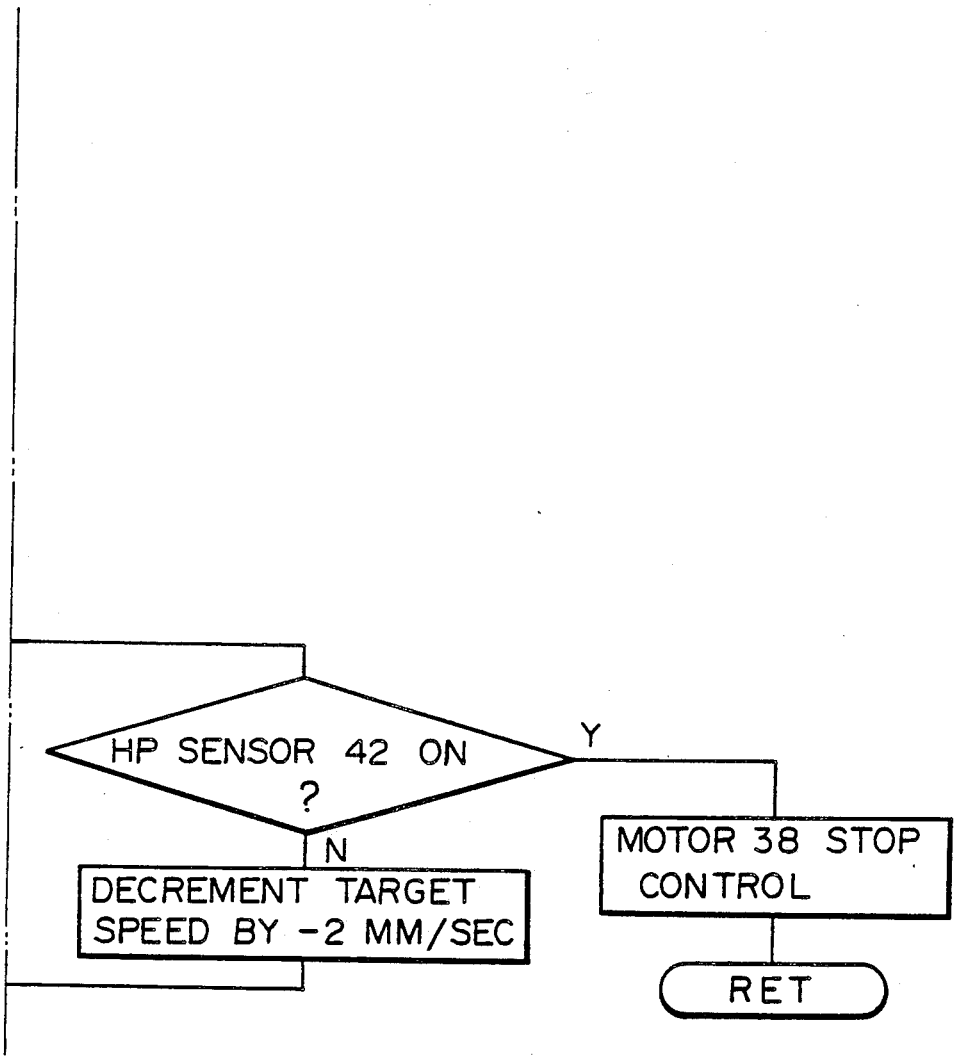

Referring to FIG. 5, how the high-speed and low-speed return modes are switched over is demonstrated in a flowchart. The figure shows that the low-speed return mode is selected only when a special copy mode is selected as discussed above. FIG. 6 is a flowchart showing a specific control procedure available with the low-speed return mode of FIG. 4B.

In summary, in accordance with the present invention, the return of a scanner after imagewise exposure is controlled basically in a high-speed return mode, while it is controlled in a low-speed return mode in a particular copy mode wherein a paper sheet is driven to an image forming station before the timing for optics to start forming an image is reached. This insures high-speed processing during ordinary copying operations and, yet, surely stops the scanner optics being returned at a predetermined position in the particular copy mode.

Various modifications will become possible for those skilled in the art after receiving the teachings of the present disclosure without departing from the scope thereof.

What is claimed is:

1. A method for controlling the driving of a scanner over a glass platen in a photocopier during an exposure and a return, comprising the steps of:

providing a motor for driving said scanner;

generating movement signals in response to the movement and direction of said scanner;

selecting the speed and direction of the motor in accordance with said movement signals and manually input information including a mode input;

switching between a high speed return and a low speed return according to said manually input information;

selecting a low speed return for a particular mode, in which a first image forming operation and a subsequent second image forming operation are performed on a paper sheet, such that a low speed return is selected in said first image forming operation, and a high speed return for other modes; and generating motor driving signals to drive said motor in accordance with the selected speed and direction.

2. The method according to claim 1, wherein a low speed return is selected for a 2-sided/composite mode and a high speed return is selected for other modes.

3. The method according to claim 1, wherein the speed of the return varies over the position along the return path.

4. The method according to claim 3, wherein the speed increases over a first portion of the return, remains constant over a second portion of the return and decreases over a third portion of the return.

5. The method according to claim 4, wherein the speed in the second portion is 1200 mm/sec for a high speed return and 600 mm/sec for a low speed return.

6. A method as claimed in claim 1, wherein said particular mode is a 2-sided/composite mode.

* * * * *